US006607325B2

(12) United States Patent
Hori

(10) Patent No.: US 6,607,325 B2
(45) Date of Patent: Aug. 19, 2003

(54) WRITING INSTRUMENT

(75) Inventor: Jiro Hori, Tsurugashima (JP)

(73) Assignee: Hics Corporation, Saitama (JP)

( * ) Notice: Subject to any disclaimer, the term of this patent is extended or adjusted under 35 U.S.C. 154(b) by 0 days.

(21) Appl. No.: 10/283,962

(22) Filed: Oct. 30, 2002

(65) Prior Publication Data

US 2003/0068191 A1 Apr. 10, 2003

Related U.S. Application Data

(63) Continuation of application No. PCT/JP01/02527, filed on Mar. 28, 2001.

(30) Foreign Application Priority Data

May 8, 2000 (JP) ..... 2000-134915

(51) Int. Cl.[7] ..... B43K 5/00

(52) U.S. Cl. ..... 401/205; 401/198; 401/199; 401/230; 401/241

(58) Field of Search ..... 401/196, 198, 401/199, 151, 202, 204, 205, 223, 224, 227, 230, 241

(56) References Cited

U.S. PATENT DOCUMENTS

| | | | |
|---|---|---|---|
| 4,770,558 | A | 9/1988 | Frietsch |
| 4,973,180 | A | 11/1990 | Hori |
| 5,249,875 | A | 10/1993 | Hori et al. |
| 5,332,326 | A | 7/1994 | Hori |
| 5,468,082 | A | 11/1995 | Hori |
| 5,556,215 | A | 9/1996 | Hori |
| 6,474,895 | B2 | 11/2002 | Hori |

FOREIGN PATENT DOCUMENTS

| | | |
|---|---|---|
| GB | 204311 | 3/1997 |
| JP | 11-510748 | 9/1999 |
| WO | WO 99/56969 | 11/1999 |

*Primary Examiner*—Tuan N. Nguyen
(74) *Attorney, Agent, or Firm*—Jordan and Hamburg LLP

(57) ABSTRACT

A writing instrument of the present invention has an ink chamber 2 formed inside a main body 1 of the writing instrument, a writing element 5 provided on a front end portion of the main body 1 of the writing instrument, a reservoir chamber 10 which is formed between the ink chamber 2 and the writing element 5 and communicates with the atmosphere and with the writing element 5, a plurality of walls 14 and 14*a* which partitions the reservoir chamber 10 and the ink chamber 2 and further partitions the ink chamber 10 into a plurality of small chambers in the axis direction, and an ink supply member 16 which penetrates the plurality of walls and supplies ink from the ink chamber 2 to the writing element 5, where each of the walls is provided with a communication hole 15 capable of holding the ink by capillary force, and these communication holes are sealed with an ink membrane.

8 Claims, 19 Drawing Sheets

WRITING INSTRUMENT

This is a continuation, of application Ser. No. PCT/JP01/02527 filed Mar. 28, 2001, now pending.

TECHNICAL FIELD

The present invention relates to a writing instrument provided with an ink supply mechanism with a simple structure, and more particularly, to a writing instrument enabling an ink storing amount to be increased, and further enabling ink to be supplied stably to a writing element.

BACKGROUND ART

Conventionally, various writing instruments have been developed of so-called direct-ink type for directly storing liquid ink in an ink chamber. Such a type of writing instrument has an advantage of capable of storing a large amount of ink, but has disadvantages of requiring mechanisms with complicated structures for adjusting an ink pressure and controlling ink supply, etc. to stably supply the ink from an ink chamber to a writing element such as a ball chip and felt chip.

As described above, in order to stably supply the ink, it should be considered to compensate for expansion and contraction of the air in an ink chamber due to changes in temperature and barometric pressure and to compensate a hydraulic pressure of the ink from the ink chamber to the writing element in writing.

In order to overcome the above problems, there is known a writing instrument with a slide plug provided in an ink chamber as disclosed in Japan Laid-Open Patent Publication HEI7-20753. The slide plug is formed to be slidable in the axis direction with the ink densely filled in the ink chamber, partitions the ink chamber into a portion of the ink and a portion of the air, slides corresponding to consumption, expansion and contraction of the ink, and thereby always maintains a pressure of the ink in the ink chamber at an atmospheric pressure.

Such a plug type of writing instrument is excellent in ink pressure compensation function, but has inconveniences such that precision control in production and assembly is strict to enable the slide plug to smoothly slide with no resistance and thereby the cost is increased.

Further, as another type, there is a gas-liquid exchange/feeder type of writing instrument as disclosed in JP Patent 2534821. This type of writing instrument is configured so that a small amount of air is led into the ink chamber in return for the ink consumption, and thereby the ink pressure inside the ink chamber is always maintained to be equal to the atmospheric pressure. In this type of writing instrument, since the air is led into the ink chamber, adjacent to the ink chamber is provided a hollow chamber or labyrinthine passage called a feeder (reverser chamber) that holds the ink that is pushed out when the air expands due to, for example, changes in temperature.

In such a type of writing instrument, when the capacity of the ink chamber is increased to increase the ink storing amount, it is required to increase the capacity of a feeder corresponding to the increased chamber capacity. However, the size of writing instrument is limited to some extent, and in such a limited space, there is a limitation in increasing the capacity of an ink chamber.

Further, the gas-liquid exchange/feeder type of writing instrument generally has a structure in which a feeder communicating with the atmosphere side communicates with an ink chamber using a passage with a thin diameter. In the passage with a thin diameter, the ink is usually held by capillary force and is sealed. Then, when a pressure difference occurs between the ink chamber and the outside, the air is led into the ink chamber through the passage with a thin diameter, or the ink is pushed out of the ink chamber, and the pushed-out ink is stored in the feeder.

Such a type of writing instrument does not require a variable portion inherently and has a simple structure, but makes it difficult to lead the air into an ink chamber corresponding to ink consumption (gas-liquid exchange) and to hold and control the ink pushed out of the ink chamber, and thus has disadvantages that it is difficult to assure stable operations.

In other words, it is difficult to always seal a passage with a thin diameter under a constant condition with the ink, and as a result, there are problems that characteristics are not-stabilized, and the ink dries in the thin diameter, which is clogged. Thus, it is not possible to always obtain adequate stability and reliability.

Accordingly, it is an object of the present invention to provide a gas-liquid exchange/feeder type of writing instrument enabling an increased capacity of an ink chamber.

Further, it is a second object of the present invention to provide a gas-liquid exchange/feeder type of writing instrument with reliability in control of gas-liquid exchange and of pushed-out ink, with a simplified reliable structure, and with ease in production.

DISCLOSURE OF INVENTION

A writing instrument according to the present invention has an ink chamber formed inside a main body of the writing instrument, a writing element provided on a front end portion of the main body of the writing instrument, a reservoir chamber which is formed between the ink chamber and the writing element and communicates with the atmosphere and with the writing element, a plurality of walls which partitions the reservoir chamber and the ink chamber and further partitions the ink chamber into a plurality of small chambers in the axis direction, and an ink supply member which penetrates the plurality of walls and supplies ink from the ink chamber to the writing element, where each wall is provided with a communication hole capable of holding the ink by capillary force.

The communication hole formed in each wall is usually sealed with an ink membrane held by capillary force, and the ink in the ink chamber is supplied to the writing element through the ink supply member. When letting the writing instrument stand for use in writing, since the communication hole at a lower side of the ink chamber is sealed with the ink membrane, the ink chamber is sealed in the vertical direction. As a result, the hydraulic pressure corresponding to length of the ink chamber is canceled, and therefore, does not affect the writing element.

Further, when the ink is consumed, or the ink and/or air in the ink chamber contracts due to changes in temperature, etc, the seal due to the ink membrane of the communication hole formed in the wall between the reservoir chamber and ink chamber is broken, and a small amount of air is led from the reservoir chamber into the ink chamber, thereby preventing an occurrence of a negative pressure inside the ink chamber. When the ink and/or air in the ink chamber expands due to changes in temperature or the like, the seal due to the ink membrane of the communication hole formed in the wall between the reservoir chamber and ink chamber is broken, and the ink is pushed out of the ink chamber to the reservoir chamber, thereby canceling the expansion in pressure inside the ink chamber. In addition, a configuration is preferable in which the ink pushed into the reservoir chamber is fed to the writing element to be consumed or returned to the ink chamber when the pressure inside the ink chamber becomes a negative pressure.

The ink chamber is partitioned into a plurality of small chambers in the axis direction by at least one wall. When the ink is consumed, the ink is consumed in a first small chamber nearest the reservoir chamber where the gas and liquid are exchanged, and the air is led to only the first small chamber from the reservoir chamber. Accordingly, even when the ink in the first small chamber is almost replaced with the air, since the capacity of the first small chamber is small, a small amount of air expands due to changes in temperature or the like, and therefore an amount of ink pushed into the reservoir is small.

Further, after the first small chamber becomes empty, the gas and liquid are exchanged between the first and second small chambers, and the air is led into the second small chamber. In this case, the ink pushed out of the second small chamber is held in the first small chamber. In other words, after the first small chamber becomes empty, the first small chamber serves as a reservoir chamber, and thereafter, another small chamber becoming empty servers as a reservoir chamber sequentially.

By such a consecutive operation, it is possible to decrease the capacity of the reservoir chamber communicating with the writing elements, and corresponding to the decreased capacity, it is possible to increase the capacity of the entire ink chamber and to store a larger amount of ink.

Further, this writing instrument has such a simple structure that the inside of the main body of the writing instrument is partitioned using a plurality of walls, thereby forming small chambers serving as a reservoir chamber and ink chamber, a communication hole of ink is formed in each wall, and that an ink supply member penetrates and is inserted through the walls, does not have any variable portion, thereby having simple operations, and therefore is high in reliability and easy in production.

BEST MODE FOR CARRYING OUT THE INVENTION

Embodiments of the present invention will be described below with reference to accompanying drawings.

First, with reference to FIGS. 1 and 2, basic principles of a writing instrument (basic principles of gas-liquid exchange/feeder type) according to the present invention will be described.

Figure 1:
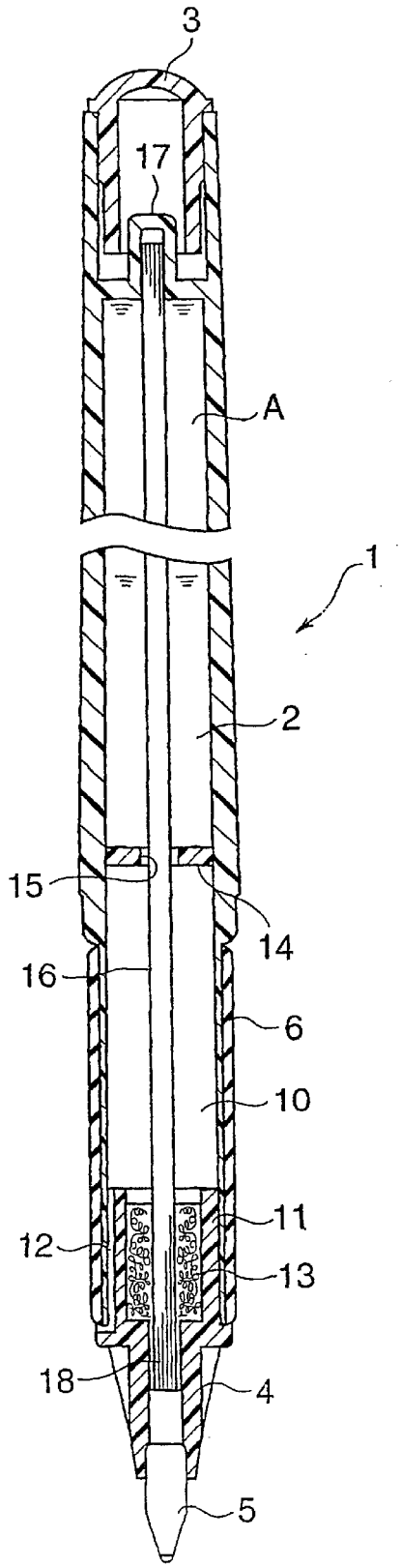
FIG. 1 is a longitudinal cross-sectional view of a writing instrument to explain the principle of the present invention.
Figure 2:
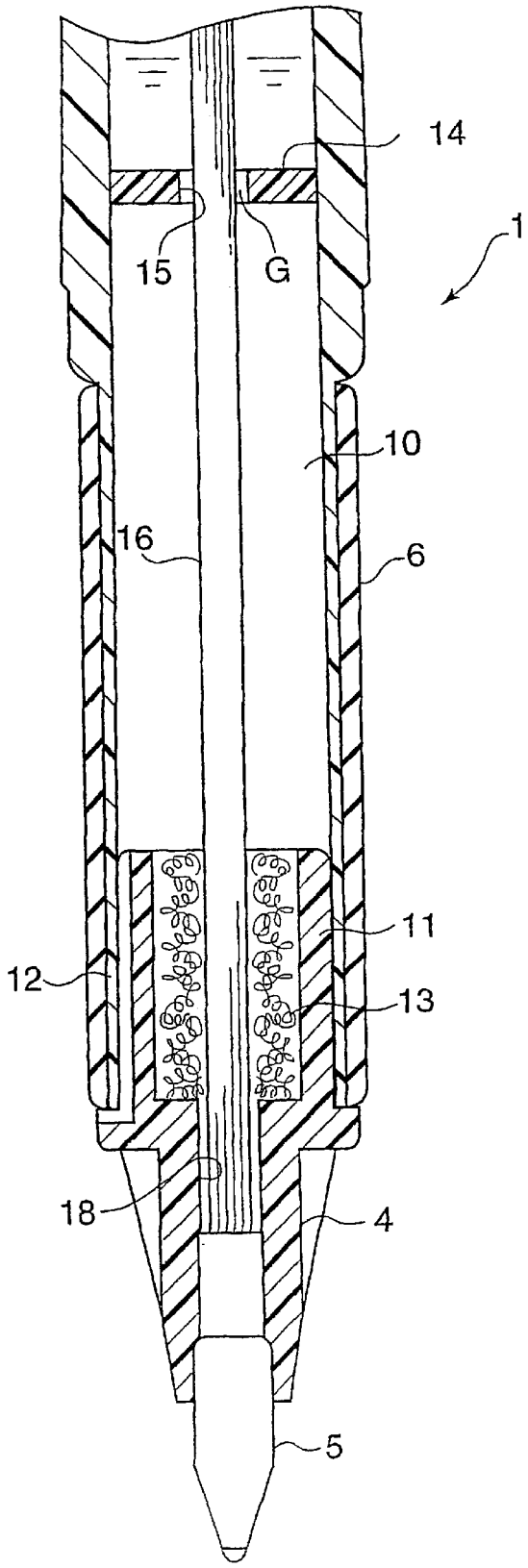
FIG. 2 is a longitudinal cross-sectional view of an enlarged primary potion of FIG. 1.
Figure 3:
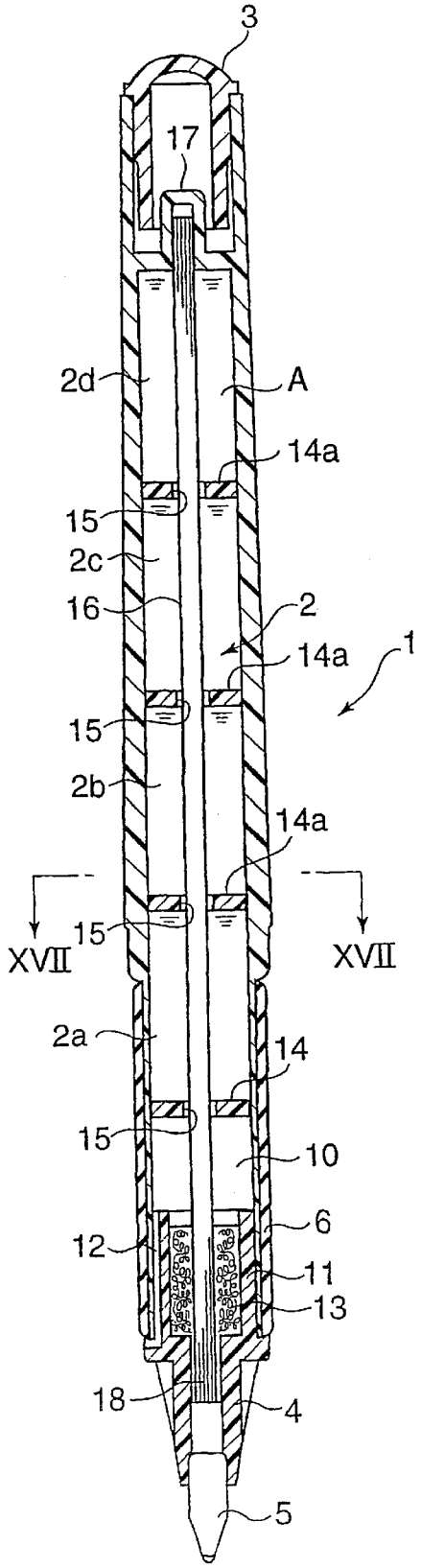
FIG. 3 is a longitudinal cross-sectional view of a writing instrument according to a first embodiment of the present invention.

FIGS. 1 and 2 illustrate a writing instrument provided with a ball chip using water-soluble ink. In the figures, reference numeral "1" denotes a barrel of the writing instrument, i.e., a main body of the writing instrument.

A wall 14 is provided inside the main body 1 in the direction perpendicular to the axis direction. A portion at a tail end side partitioned by the wall 14 is configured to be a cylinder-shaped ink chamber 2 with ink A filled therein and a reservoir chamber 10 with a front end side in the form of a cylinder. The wall 14 is configured by pressing a disk-shaped member inside the main body 1, and is provided with a through hole 15 at its center portion.

The main body 1 is provided with an end plug 3 at its tail end portion, and is further provided with a chip ball holder 4 at its front end portion. The front end portion of the chip holder 4 is provided with a ball chip 5 for water-soluble ink. A rubber boot 6 for anti-skid is provided on the outer periphery of the front end portion of the main body 1.

An upper end portion of the chip holder 4 is formed in the shape of a cup, inserted into the main body 1, and forms an ink receiving portion 11 of the reservoir chamber 10. A bottom of the receiving portion 11 is provided with a porous ink holding member 13 made of a fiber material or the like, and thus formed to impregnate ink therewith to hold. In addition, in the present invention, the ink holding member 13 does not need to be provided in particular, and is not limited in structure to a porous member composed of a fiber material or the like even if the member 13 is provided.

On the outer periphery of the receiving portion 11 of the chip holder 4 is formed a groove extending in the axis direction. The groove forms an atmosphere communication passage 12 that causes the inner periphery of the main body 1 to communicate with the atmosphere. Thus, the reservoir chamber 10 communicates with the atmosphere through the atmosphere communication passage 12. The atmosphere communication passage 12 is configured to prevent the ink in the reservoir chamber 10 from leaking outside. In this case, by providing the porous ink holding member 13 inside the reservoir chamber 10, the ink having flowed in the reservoir chamber is impregnated and held in the ink holding member, and assuredly prevented from leaking from the atmosphere communication passage 12 to the outside.

Inside the main body 1 is provided an ink supply member 16 along the axis direction. The ink supply member 16 is a member referred to a relay core, composed of a porous rod-shaped member made of a large number of fibers gathered and compressed parallel to the axis direction, and supplies the ink by capillary force. In addition, members referred to a relay core include one obtained by applying water-non-permeable coating to the outer periphery of a fiber-gathered member as described above. However, in the structural example illustrated in the figure, the member without water-non-permeable coating on its outer periphery is used, and thus is capable of absorbing the ink from the outer periphery.

Accordingly, in this structural example, the ink is capable of flowing in and out through the periphery of the ink supply member 16 over its entire length. The ink is reliably and stably supplied from the ink chamber 2 to writing element 5 by capillary force, and since the porous relay core itself has the ink flow rate adjusting function, it is possible to supply the ink stably.

The ink supply member 16 is provided substantially over the entire length along the center axis line of the main body 1, and the front end portion of the member 16 is held in a holding hole 18 formed in the chip holder 4 with a gap of some extent. A tail end portion of the ink supply member 16 is engaged and held in a holding member 17 formed in the tail end portion of the main body 1.

A middle portion of the ink supply member 16 penetrates the ink chamber 2, through hole 15 of the wall 14 and reservoir chamber 10. In this case, an inner diameter of the through hole 15 of the wall 14 is formed to be a little larger than an outer diameter of the ink supply member 16, and a predetermined circular gap G is prescribed between the outer periphery of the ink supply member 16 and the inner periphery of the through hole 15.

The gap G forms a communication hole capable of holding the ink due to capillary force. In this case, the size of the gap G is set as appropriate corresponding to, for example, type of ink to be used, and is usually set closed to prevent the air from entering.

The operation of the writing instrument configured as described above will be described.

Usually, the gap G of the wall 14 is sealed with an ink membrane. Accordingly, even when the writing instrument is in a substantially vertical posture with the writing element directed downward, the ink does not flow from the gap G.

The ink A in the ink chamber 2 is supplied to the ball chip 5 through the ink supply member 16, thereby enabling writing. Then, when the ink in the ink chamber 2 is consumed by writing, the pressure inside the ink chamber 2 becomes a negative pressure. By this negative pressure, the seal of the ink membrane held in the gap G is broken, a small amount of air conforming to the consumed amount is led to the ink chamber 2 from the reservoir chamber 10 through the gap G, then the negative pressure inside the ink chamber 2 is canceled, and the pressure is made equal to the atmospheric pressure. In response to this behavior, the gap G is sealed again with the ink membrane due to capillary force.

After the air is led into the ink chamber 2, the air expands or contracts due to changes in temperature or the like. In this case, when the led air contracts, the ink membrane held in the gap G is broken and the air is introduced similarly, thereby preventing the ink chamber 2 from having a negative pressure. When the air in the ink chamber 2 expands, due to the pressure, the ink membrane is broken and the ink is pushed out of the gap G to the reservoir chamber 10. The pushed-out ink is impregnated in the ink holding member 13, and the ink held in the ink holding member 13 is consumed by writing, or is returned to a side of the ink chamber 2 through the ink supply member 16 when the pressure inside the ink chamber 2 becomes negative. Accordingly, an excess amount of ink does not stay in the reservoir chamber 10.

The writing instrument as described above has a simple structure without a variable portion, and therefore is easy in production, simple in operation principle, and high in reliability. In particular, the gap G between the through hole 15 formed in the wall and ink supply member 16 is only a portion for controlling introduction of air and exclusion of ink into/from the ink chamber 2 for compensating for expansion and contraction due to ink consumption, changes in temperature, changes in barometric pressure or the like in the ink chamber 2. Further, the ink is always supplied to the gap G from the ink chamber 2 and ink supply member 16 to maintain the ink membrane. Accordingly, even when leaving the writing instrument unused for a long time, it does not happen that the ink in the gap G dries and thereby clogging occurs, and it is possible to secure remarkably stable operations.

Further, even when leaving the writing instrument standing with the writing element directed upward for a long time, since the ink is supplied into the gap G due to capillary force from the periphery surface of the porous ink supply member 16 made of a fiber-gathered member and is held in the gap G, it does not happen that the ink in the gap G dries and thereby clogging occurs, and it is possible to obtain a stable seal characteristic and improved reliability.

Furthermore, the ink chamber 2 is closed at its tail end side, and the gap G at the front end side of the chamber 2 is usually sealed with the ink membrane. Accordingly, even when letting the writing instrument stand in a posture as illustrated in FIG. 1 in writing, the hydraulic pressure inside the ink chamber 2 has little effect on the ink supply member 16. Thus, the control is performed for ink stable supply.

Moreover, in this structural example, the porous ink supply member 16 composed of the fiber-gathered member penetrates the reservoir chamber 10 communicating with the atmosphere with the outer periphery of the member 16 exposed, thus providing the function of compensating for changes in the hydraulic pressure in this portion or in other pressure.

The reasons for such a function have not been analyzed in detail currently, but there considered is that since the ink is held in the ink supply member by capillary force, and a free surface of the ink is formed on the outer periphery of the ink supply member and is in contact with the air in the reservoir chamber having a pressure equal to the atmospheric pressure, a pressure difference is difficult to occur inherently between the ink in the ink chamber and the atmosphere, and that since the ink contained in the ink supply member is in contact with the material composing the ink supply member in large surface area, the air is prevented by capillary force serving on the surface from entering, and even when a small pressure difference occurs due to the hydraulic pressure in the axis direction of the ink supply member, the pressure difference is not conveyed directly to the writing element.

In the writing instrument with the above configuration, since the ink chamber 2 is composed of a single space, an amount of air staying in the ink chamber 2 is increased as the ink is consumed. Therefore, when an expansion amount of air is increased due to changes in temperature, etc, an amount of ink pushed out to the reservoir chamber 10 is increased.

Specific embodiments using the above-mentioned operational principles according to the present invention will be described below. In addition, in embodiments of the present invention described later, members having the same function and effect as in the structural example illustrated in FIGS. 1 and 2 are assigned the same reference numerals, and descriptions thereof are omitted or simplified.

FIGS. 3, 4A to 4D, 5A and 5B illustrate the first embodiment of the present invention.

In this embodiment, the ink chamber 2 is provided with a plurality of, for example, three walls 14*a*, and is partitioned in the axis direction into a first small chamber 2*a*, second small chamber 2*b*, third small chamber 2*c* and fourth small chamber 2*d*. These walls 14*a* have the same structure as that of the wall 14 which partitions the ink chamber 2 and the reservoir chamber 10. The ink supply member 16 penetrates the through hole 15 of each wall 14*a*. Thus, the ink chamber 2 is composed of small chambers 2*a* to 2*d* partitioned in the axis direction.

The operation of the first embodiment will be described.

Figures 4A, 4B, 4C, 4D:
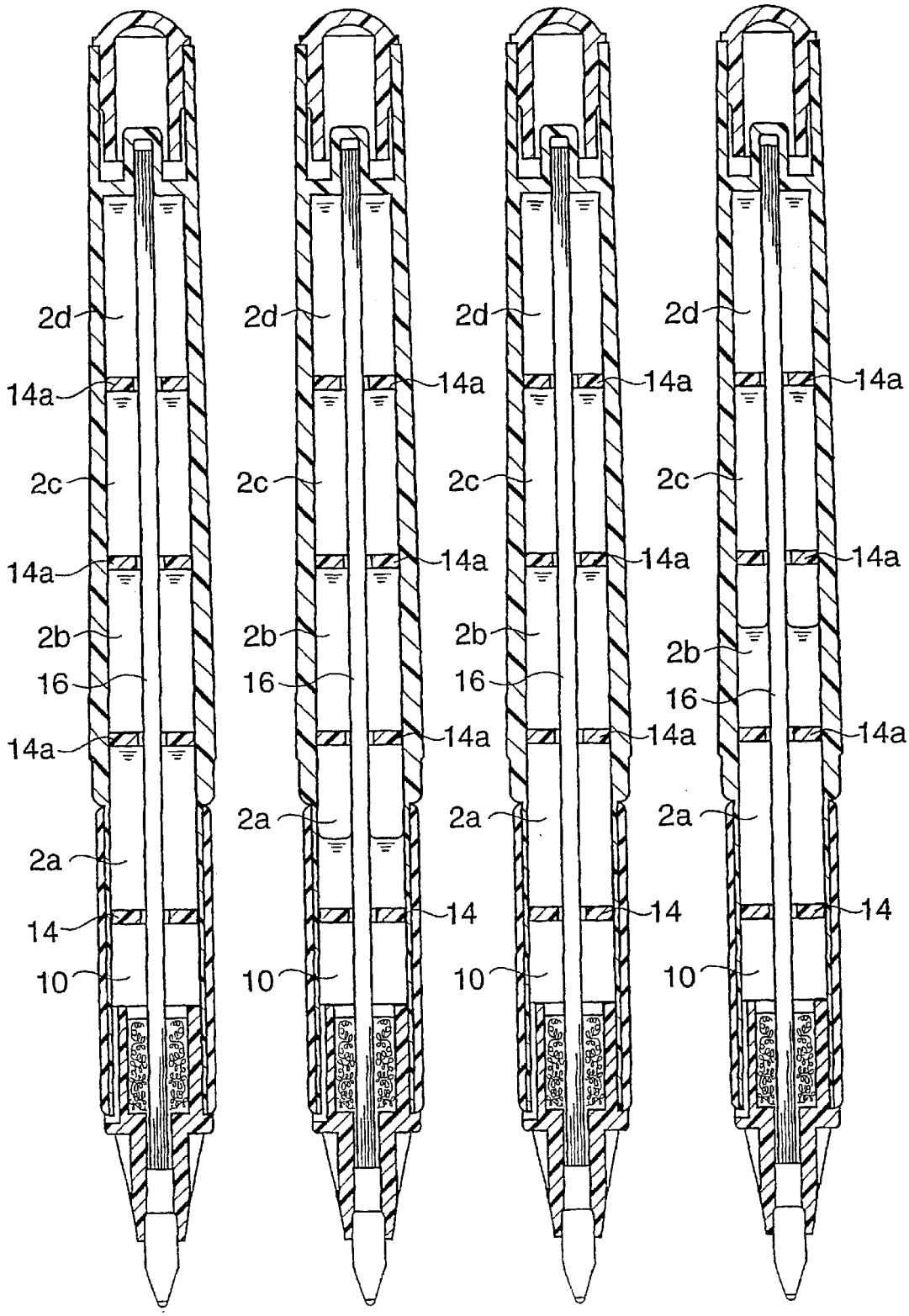
FIGS. 4A to 4D are longitudinal cross-sectional views of the writing instrument to explain sequential operations in the first embodiment.

In a first state of the writing instrument, as shown in FIG. 4A, all the first small chamber 2*a*, second small chamber 2*b*, third small chamber 2*c* and fourth small chamber 2*d* are filled with the ink A.

In this structure, when the ink is consumed by writing, as shown in FIG. 4B, the ink in the first small chamber 2*a* where the gas-liquid exchange is performed with the reservoir chamber 10 is preferentially consumed, while the air is led into the first small chamber 2*a*. Then, as shown in FIG. 4C, when the ink in the first small chamber 2*a* is all consumed, as shown in FIG. 4D, the first small chamber 2*a* functions as a reservoir chamber, the gas-liquid exchange is thereby performed in the second small chamber 2*b*, and the ink in the second small chamber 2*b* is consumed preferentially. In this way, the ink is consumed from the first small chamber 2*a* to fourth small chamber 2*d* sequentially in this order, and the air is introduced.

Figure 5A:
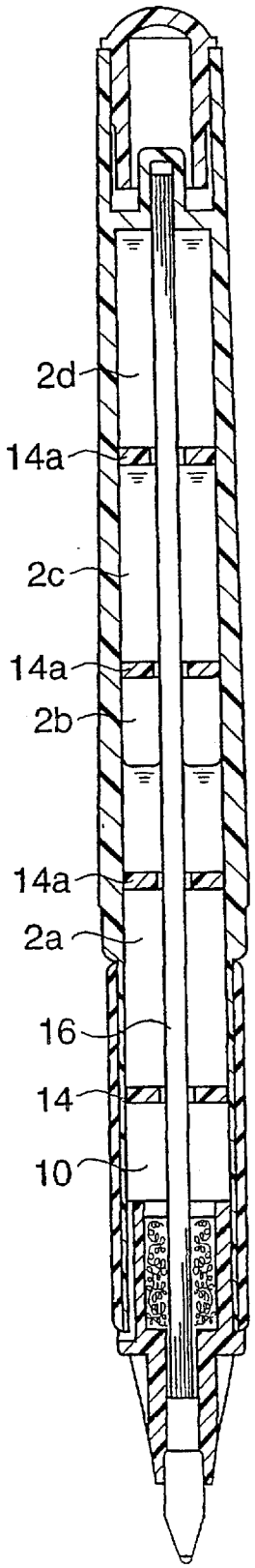
FIGS. 5A and 5B are longitudinal cross-sectional views of the writing instrument to explain sequential operations in the first embodiment, and illustrate a first small chamber serving as a reservoir chamber.
Figure 5B:
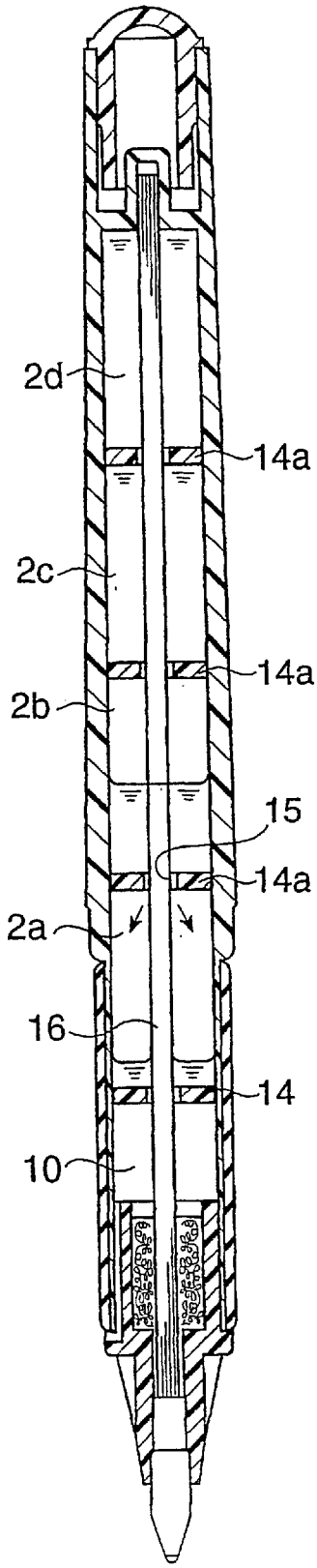

According to this structure, when the air in the first small chamber 2*a* expands, according to the operational principle as described above, the ink in the first small chamber 2*a* is pushed to the reservoir chamber 10 and stays in the reservoir chamber 10. Then, as shown in FIG. 5A, when the ink in the first small chamber 2*a* is consumed and the chamber 2*a* is emptied, the air stays in the second small chamber 2*b*. When the air in the chamber 2*b* expands, as shown in FIG. 5B, the ink in the second small chamber 2*b* is pushed to the first small chamber 2*a* and stays in the chamber 2*a*. In other words, after the ink in the first small chamber 2*a* is consumed, the first small chamber 2*a* functions as a reservoir chamber, and similarly, the second small chamber 2*b* and third small chamber 2*c* function as a reservoir chamber sequentially.

Thus, the ink chamber 2 is divided into small chambers which function as a reservoir chamber sequentially in ascending order of height of a chamber position as the ink is consumed, whereby the need of increasing the capacity of the reservoir chamber 10 is eliminated. In other words, since the capacity of the first small chamber 2*a* is small, an amount of ink pushed out of the chamber 2*a* is also small, and therefore, the capacity of the reservoir chamber 10 is made small. As a result, corresponding to the decreased capacity, it is possible to increase the entire capacity of the ink chamber 2, and to increase an amount of ink to store.

Figure 6:
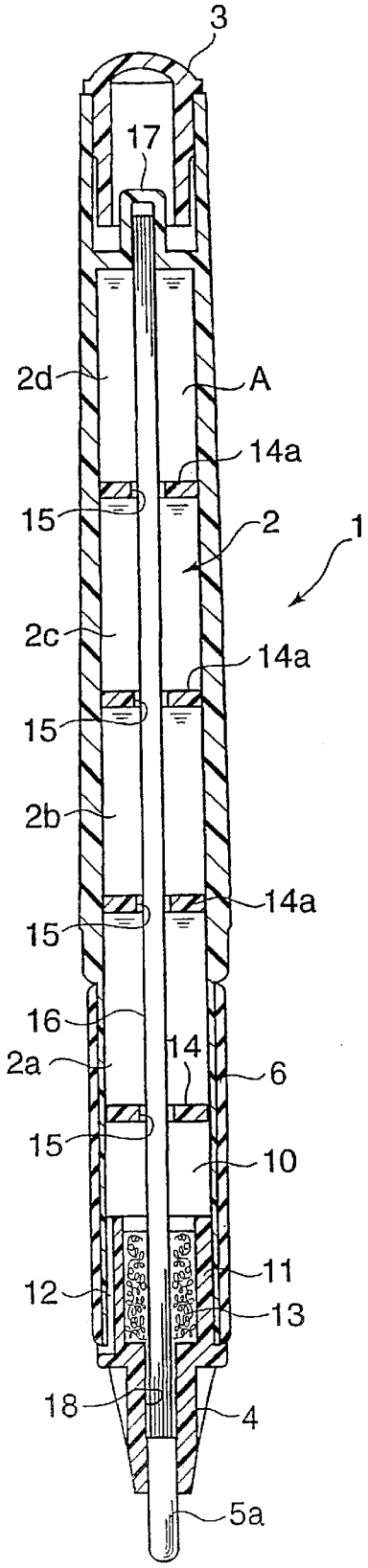
FIG. 6 is a longitudinal cross-sectional view of a writing instrument according to a second embodiment of the present invention.

FIG. 6 is a view illustrating the second embodiment of the present invention. In this embodiment, a felt chip 5*a* is provided as a writing element. Thus, the present invention is not limited in writing element communicating with the ink supply member, and it is possible to attach various types of writing elements.

Figure 7:
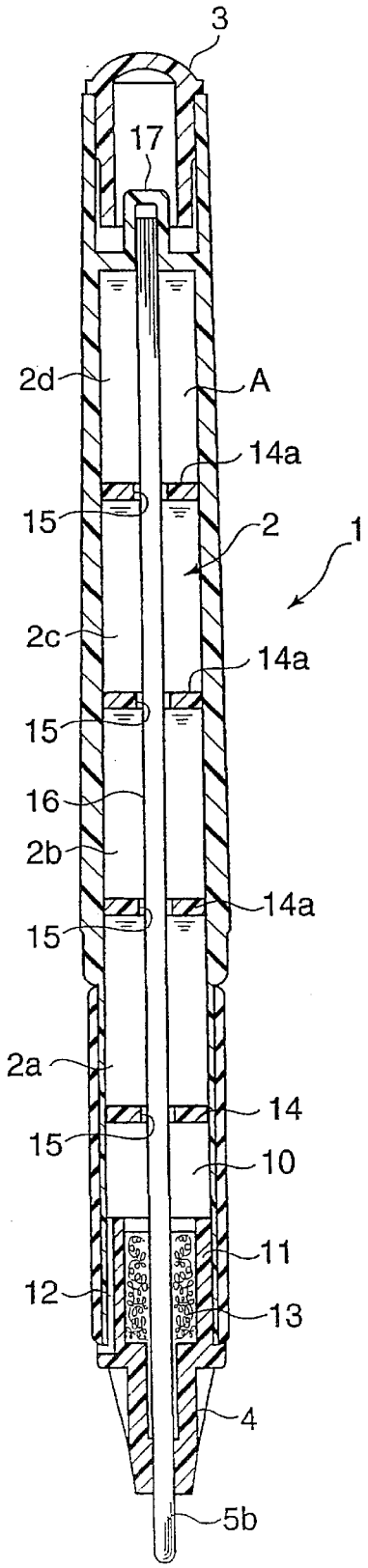
FIG. 7 is a longitudinal cross-sectional view of a writing instrument according to a third embodiment of the present invention.

FIG. 7 is a view illustrating the third embodiment of the present invention. In this embodiment, the front end portion of the porous ink supply member 16 extends, and forms a felt chip portion 5*b*. In this way, a writing element can be formed integrally from the material of the ink supply member 16, and such a construction simplifies the structure.

Figure 8:
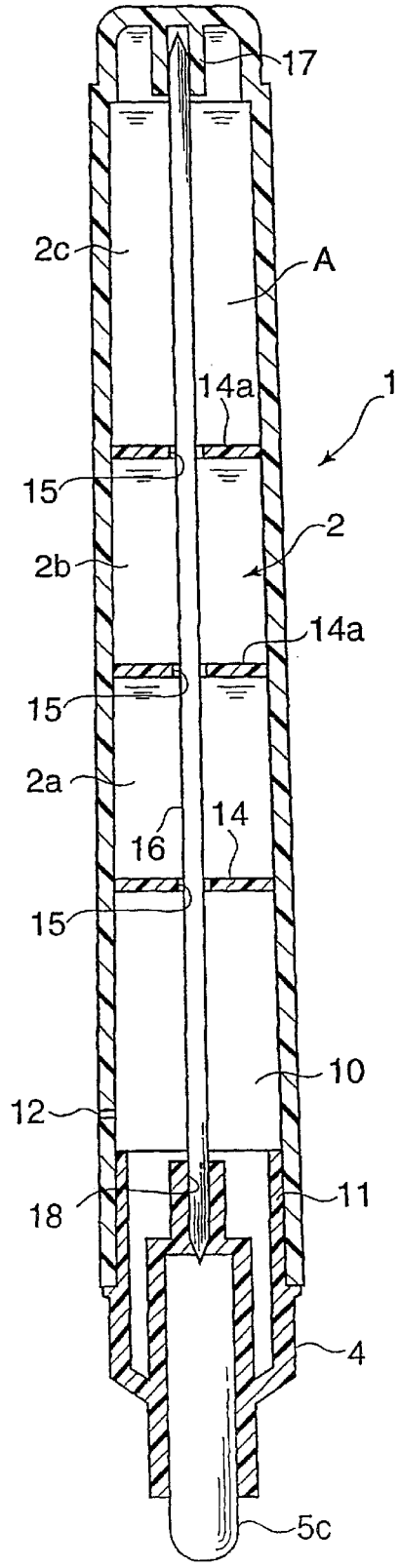
FIG. 8 is a longitudinal cross-sectional view of a writing instrument according to a fourth embodiment of the present invention.

FIG. 8 is a view illustrating the fourth embodiment of the present invention. In this embodiment, the ink chamber 2 is partitioned into three chambers with two walls, and the ink holding member 13 is not provided. The writing element is composed of a felt chip 5*c* with a thick diameter suitable for writing instruments providing thick handwriting such as a white board marker pen.

In this embodiment, since the ink holding member is not provided, the atmosphere communication passage 12 communicating with the reservoir chamber 10 is formed in a side wall of the main body of the writing instrument, thereby preventing the ink pushed to the reservoir chamber 10 from leaking outside.

Thus, it is possible to modify as appropriate the number of small chambers partitioned in the ink chamber, composition of a writing element, and position in which an atmosphere communication passage is formed.

Further, in this embodiment, since a large amount of ink is consumed, the capacity of the ink chamber 2 is increased. In response to this, capacities of the first small chamber 2*a* and second small chamber 2*b* are small, and the capacity of the third chamber 2*c* is large. In this way, an amount of ink pushed out of the first chamber 2*a* is deceased so as to decrease the capacity of the ink reservoir chamber 10. In this case, among the small chambers composing the reservoir chamber 10 and ink chamber 2, one or more chambers at the writing element side are small, and the others are made larger as the chamber is spaced a more distance away from the writing element. It is thereby possible to effectively increase the capacity of the ink chamber 2.

Figure 9:
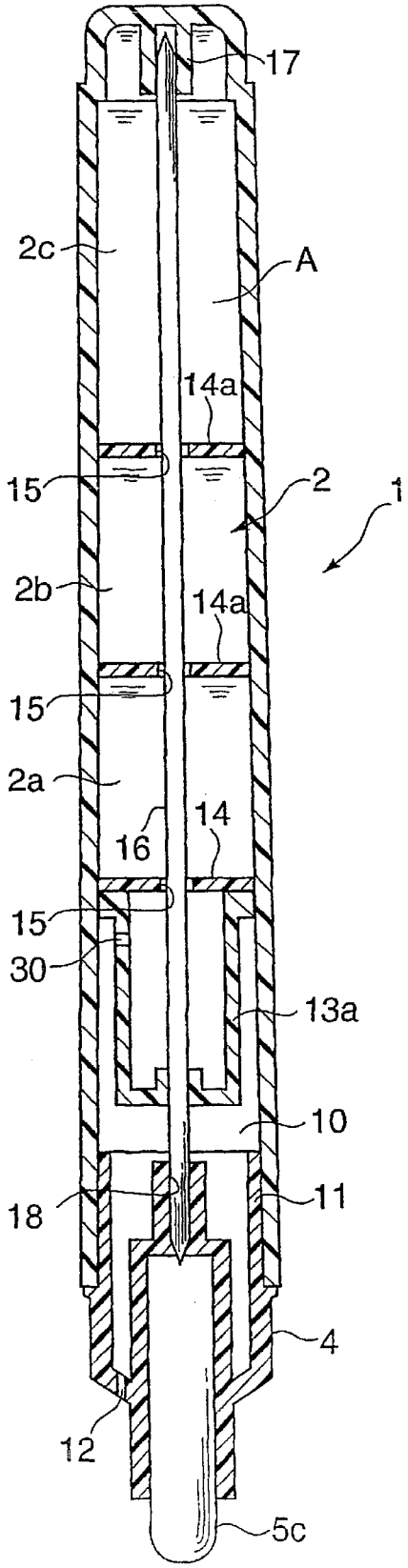
FIG. 9 is a longitudinal cross-sectional view of a writing instrument according to a fifth embodiment of the present invention.

FIG. 9 is a view illustrating the fifth embodiment of the present invention. In this embodiment, a cup-shaped ink holding member 13*a* is provided in the reservoir chamber 10 to be in intimate contact with the wall 14. An upper portion of the cup-shaped ink holding member 13*a* is provided with a communication hole 30, thereby causing the reservoir chamber 10 to communicate with the inside of the ink holding member 13*a*.

According to this structure, since the ink pushed out of the first small chamber 2*a* stays in the cup-shaped ink holding member 13*a*, the ink is assuredly prevented from leaking outside. Therefore, despite the atmosphere communication passage 12 communicating with the reservoir chamber 10 being formed in a side portion of the writing element 5*c* in the vertical direction, the ink does not leak from the passage 12.

Figure 10:
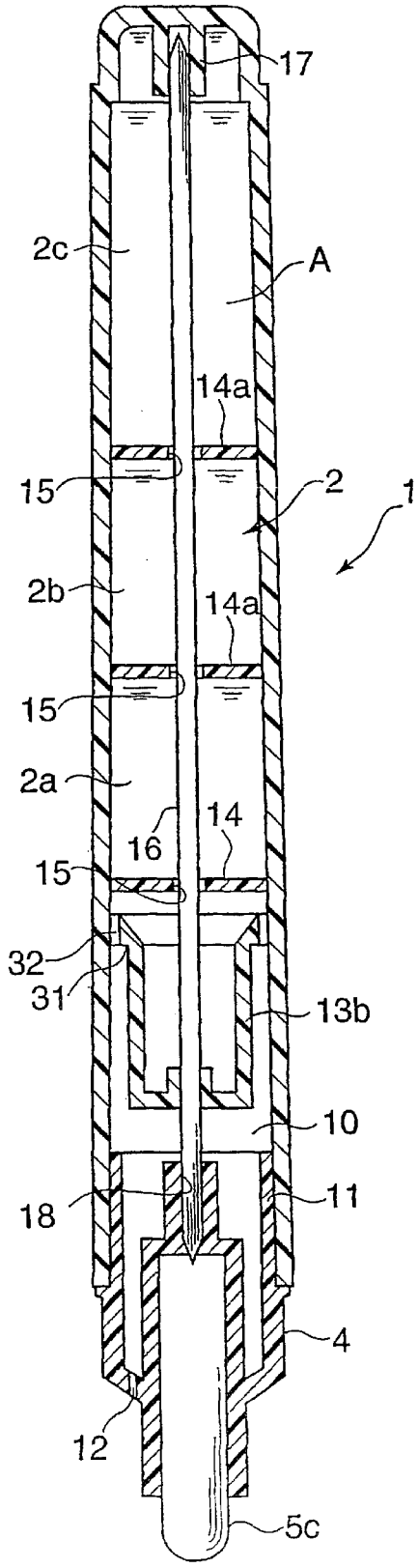
FIG. 10 is a longitudinal cross-sectional view of a writing instrument according to a sixth embodiment of the present invention.

FIG. 10 is a view illustrating the sixth embodiment of the present invention. In this embodiment, a cup-shaped ink holding member 13*b* is provided in the reservoir chamber 10 to be spaced a predetermined distance away from the wall 14. A communication groove 32 is formed on the outer periphery of an upper end portion 31 of the cup-shaped ink holding member 13*b*, thereby causing the reservoir chamber 10 to communicate with the inside of the ink holding member 13*b*.

Also in such a structure, since the ink pushed out of the first small chamber 2*a* stays in the cup-shaped ink holding member 13*b*, the ink is assuredly prevented from leaking outside.

Figure 11:
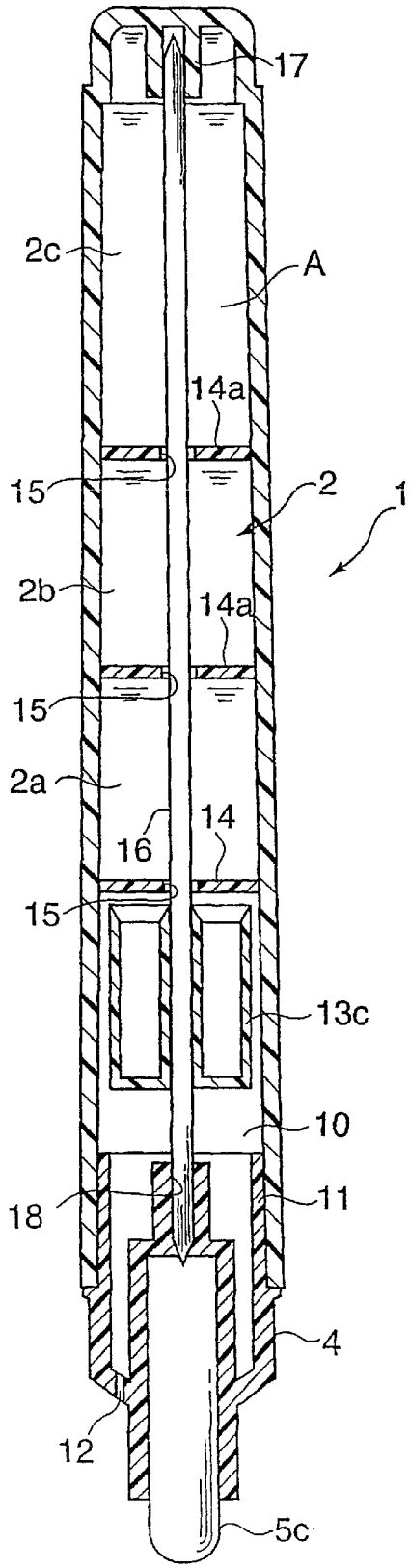
FIG. 11 is a longitudinal cross-sectional view of a writing instrument according to a seventh embodiment of the present invention.

FIG. 11 is a view illustrating the seventh embodiment of the present invention. In this embodiment, in the reservoir chamber 10 is provided a cup-shaped ink holding member 13*c* that maintains the sealing and is slidable in the axis direction.

According to this structure, since the ink pushed out of the first small chamber 2*a* stays in the cup-shaped ink holding member 13*c*, the ink is assuredly prevented from leaking outside. Further, when the air and/or ink expands/contracts in the ink chamber 2 due to changes in temperature, etc, the slidable ink holding member 13*c* slides to compensate for the expansion/contraction.

Figure 12A:
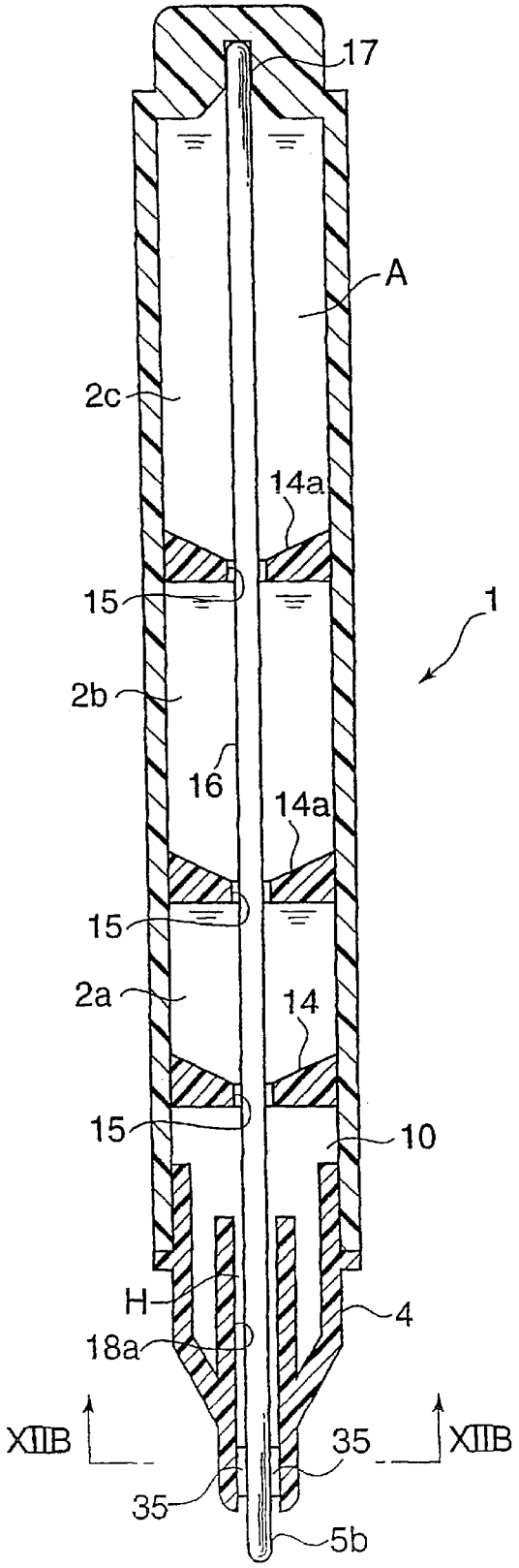
FIG. 12A is a longitudinal cross-sectional view of a writing instrument according to an eighth embodiment of the present invention.
Figure 12B:
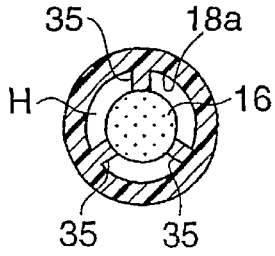
FIG. 12B is a cross-sectional view taken along line XIIB—XIIB of FIG. 12A.

FIGS. 12A and 12B are views illustrating the eighth embodiment of the present invention. In this embodiment, the front end portion of the porous ink supply member 16 extends, and forms the felt chip portion 5*b*. The inner diameter of a holding hole 18*a* of the chip holder 4 is greater than the outer diameter of the ink supply member 16 (felt chip portion 5*b*), gaps H are formed between the hole 18*a* and member 16, and the reservoir chamber 10 communicates with the atmosphere through the gaps H. Therefore, in this embodiment the atmosphere communication passage 12 as described previously is eliminated. Further, as shown in FIG. 12B, on the inner periphery of a front end portion of the holding hole 18*a* are provided a plurality of holding projecting portions 35 that project from the periphery and hold the felt chip portion 5*a*.

The gaps H usually hold the ink by capillary force and seal the reservoir chamber 10. When a pressure difference occurs between the reservoir chamber 10 and atmosphere, the seal by the ink membrane is broken, and the chamber 10 communicates with the atmosphere. Accordingly, in the structure in this embodiment, since the gaps H are usually sealed, the ink is effectively prevented from drying.

Figure 13:
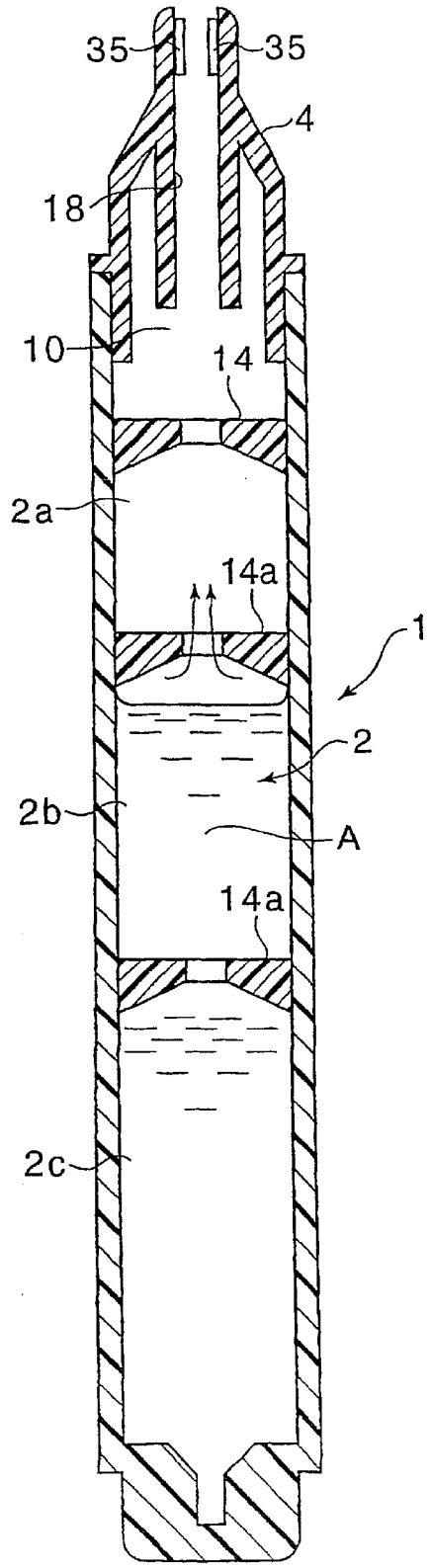
FIG. 13 is a longitudinal cross-sectional view showing an example of a production method of the writing instrument according to the eighth embodiment.

Further, in this embodiment, the face of each of walls 14 and 14*a* at the tail plug side is tapered and tilted towards the through hole 15. When filling the ink into the writing instrument, before the ink supply member 16 is attached, as illustrated in FIG. 13, the ink is injected while holding the main body of the writing instrument substantially vertically with the front end side directed upward. In this case, since the face of the wall 14 at the tail plug side is tapered, the air is guided to the tapered face and assuredly exhausted, and any air bubble does not remain at lower portions of walls 14 and 14*a*.

Figure 14:
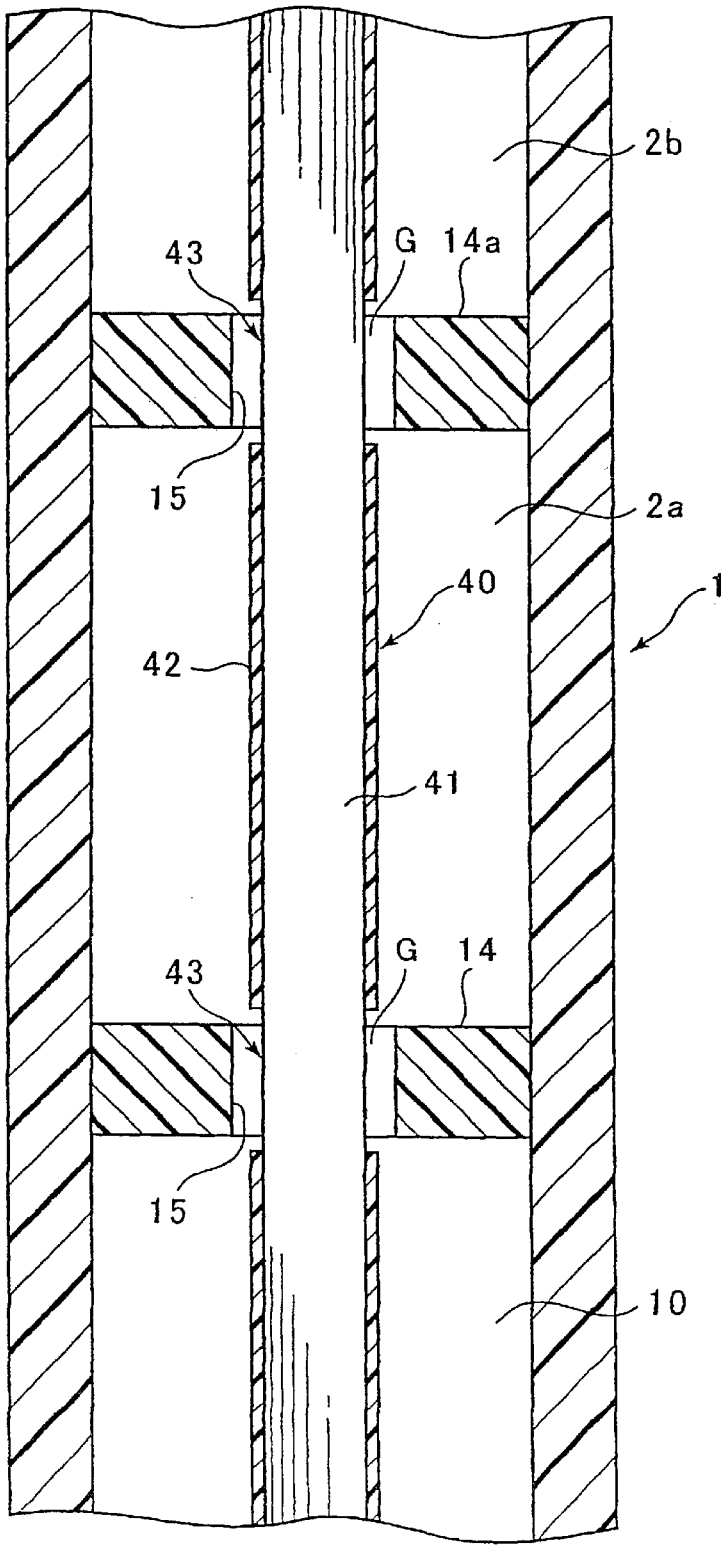
FIG. 14 is an enlarged longitudinal cross-sectional view of part of the writing instrument according to a ninth embodiment of the present invention.

FIG. 14 illustrates the ninth embodiment of the present invention, and is a view illustrating enlarged portions of the ink chamber and reservoir chamber. In this embodiment, an ink supply member 40 is composed of a rod-shaped relay core 41 made of a porous material such as a fiber-gathered member and an ink-non-permeable coating 42 that is coated on the periphery surface of the core 41.

Part of the coating 42 is removed at portions opposed to the inner periphery of the through hole 15 and in the vicinity of the hole 15 in each of walls 14 and 14*a*, and such portions form communication portions 43 through which the ink flows.

According to this embodiment, despite the outer periphery surface of the ink supply member being ink-non-permeable, since communication portions 43 are formed in and adjacent to the through holes 15, the ink is capable of flowing from the ink chamber to the inside of the ink supply member through communication portions 43, and the ink at small chambers is consumed in ascending order of height of a chamber position. Further, at portions in through holes 15 are provided communication portions 43 where the rod-shaped relay core 41 made of the porous material is exposed. Therefore, similarly to the above structures, the ink membrane is usually held in constant state in the gap G, thereby stabilizing characteristics, while it does not happen that the ink in the gap G dries and thereby clogging occurs, and it is thus possible to obtain high stability and reliability.

Further, since the relay core 41 is coated with the coating 42 except communication portions 43 in the gap G, it is possible to prevent a solvent of the ink from evaporating from the surface of the ink supply member 40, for example, in the feeder chamber 10. Accordingly, there are advantages in the case of using fast-drying ink.

Figure 15:
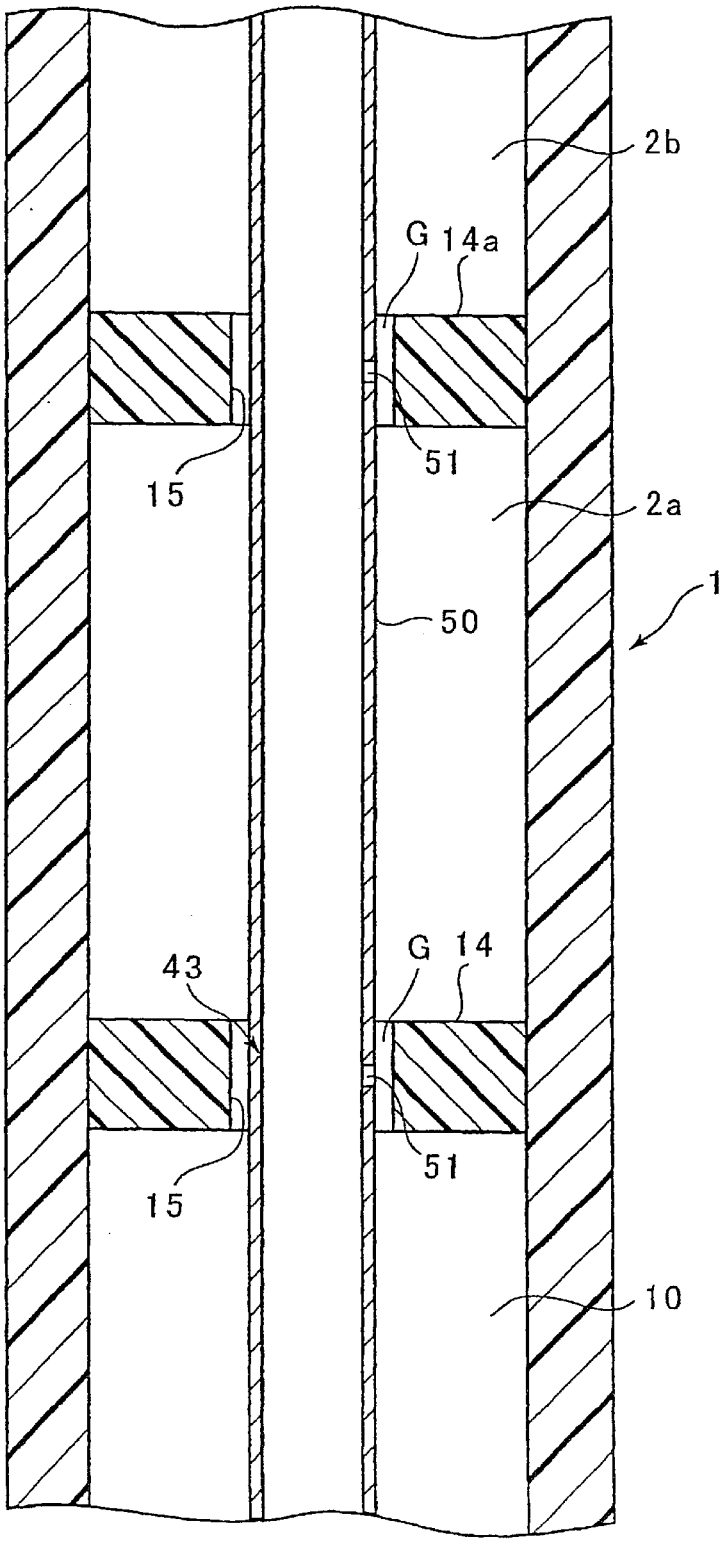
FIG. 15 is an enlarged longitudinal cross-sectional view of part of the writing instrument according to a tenth embodiment of the present invention.

FIG. 15 illustrates the tenth embodiment of the present invention, and is a view illustrating enlarged portions of the ink chamber and reservoir chamber. An ink supply member 50 of this embodiment is composed of a tube with a small diameter, and communication portions 51 through which the ink flows are formed at portions opposed to inner peripheries of through holes 15 of walls 14 and 14*a*, respectively.

Figure 16:
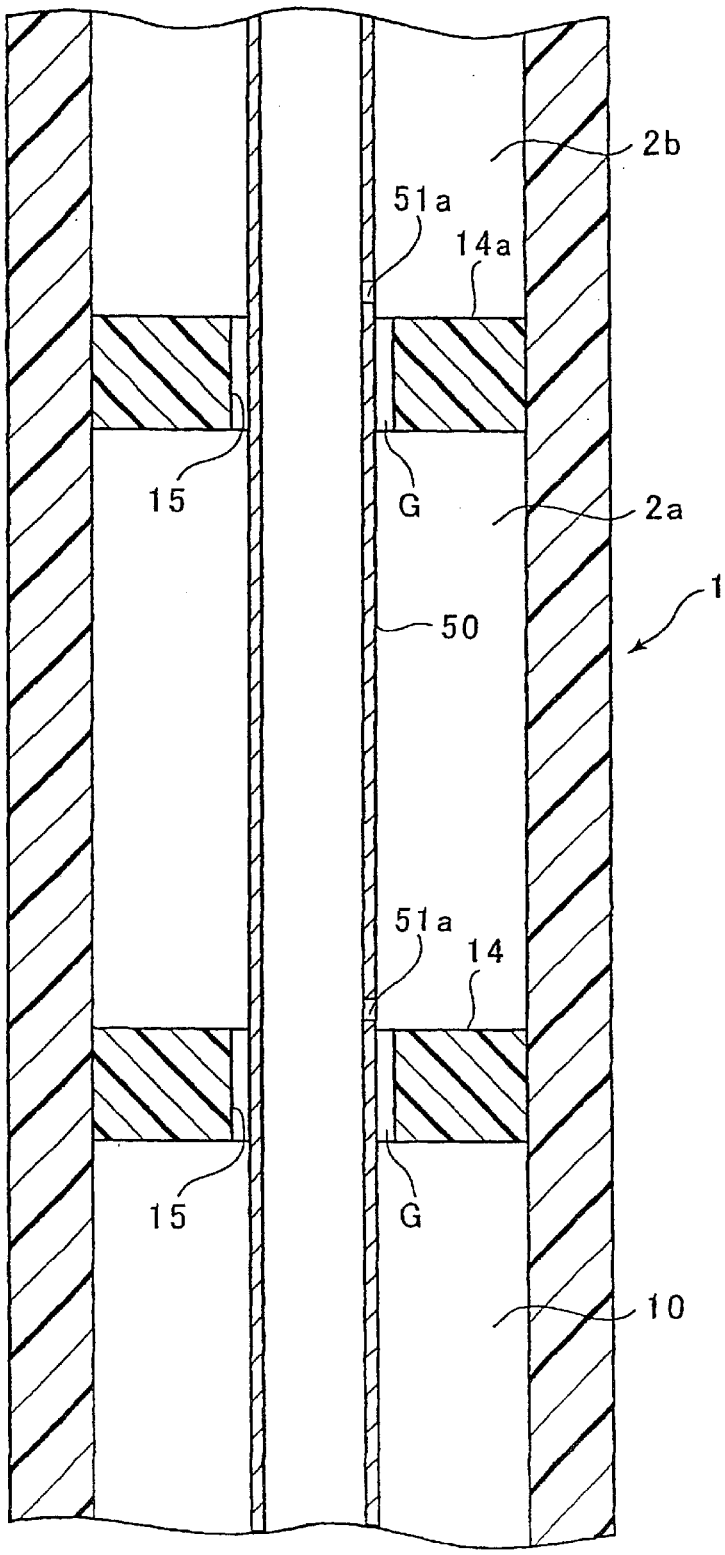
FIG. 16 is an enlarged longitudinal cross-sectional view of part of the writing instrument according to an eleventh embodiment of the present invention.
Figure 17:
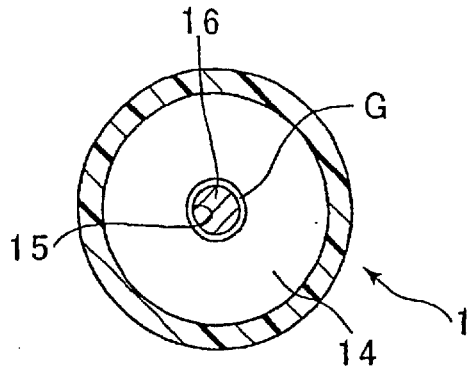
FIG. 17 is a cross-sectional view taken along line XVII—XVII of FIG. 3.

FIG. 16 illustrates the eleventh embodiment of the present invention, and is a view illustrating enlarged portions of the ink chamber and reservoir chamber. Also in this embodiment, the ink supply member 50 is composed of a tube with a small diameter, and communication portions 51*a* are formed in the vicinities of through holes 15 of walls 14 and 14*a*.

Also in the tenth and eleventh embodiments as described above, in the same way as in the ninth embodiment, it is possible to prevent a solvent of the ink from evaporating from the surface of the ink supply member 50, for example, in the feeder chamber 10. Accordingly, there are advantages in the case of using fast-drying ink.

In the case where the ink supply member is made of the porous materially with the coating as illustrated in FIG. 14, or of a small-diameter tube as illustrated in FIGS. 15 and 16, each of communication portions 43, 51 and 51*a* is only required to be formed in a position that assures the ink flow between the ink supply member and gap G in the though hole through the communication portion due to capillary force.

In the above-mentioned embodiments, each of communication holes formed on walls 14 and 14*a* is formed of the gap G between the ink supply member 16 and the inner periphery of the through hole 15 through which the member 16 passes. However, communication holes of the present invention are not limited to the aforementioned configuration, and may be formed in positions spaced away from through holes 15 of the ink supply member 16.

FIGS. 18 to 22 illustrate various modifications of communication hole formed in the wall 14 (14*a*).

Figure 18:
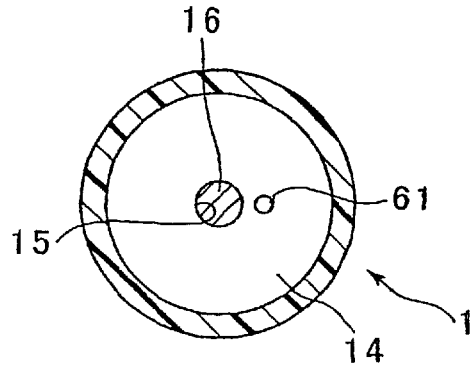
FIG. 18 is a cross-sectional view of a first modification of a wall corresponding to FIG. 17.

In a structure illustrated in FIG. 18, a circular communication hole 61 with a small diameter is formed in a position adjacent to the through hole 15 in the wall 14. The communication hole 61 is usually sealed with the ink membrane by capillary force of the ink. Therefore, in this structure a gap is not formed between the inner periphery of the through hole 15 and the outer periphery of the ink supply member 16.

Figure 19:
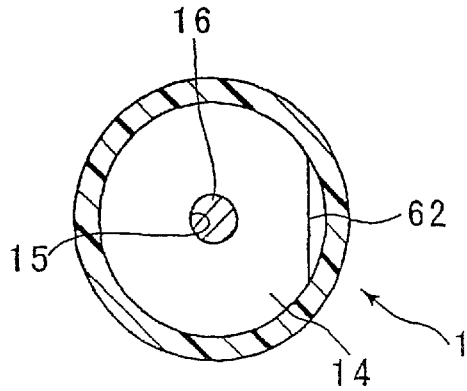
FIG. 19 is a cross-sectional view of a second modification of the wall corresponding to FIG. 17.

In a structure illustrated in FIG. 19, part of the outer portion of the wall 14 is removed in the shape of a plane, thereby forming an arc-shaped communication hole 62 between the wall 14 and the inner periphery of the main body 1 of the writing instrument. The communication hole 62 is usually sealed with the ink membrane by capillary force of the ink. Also in this embodiment, a gap is not formed between the inner periphery of the through hole 15 and the outer periphery of ink supply member 16.

Figure 20:
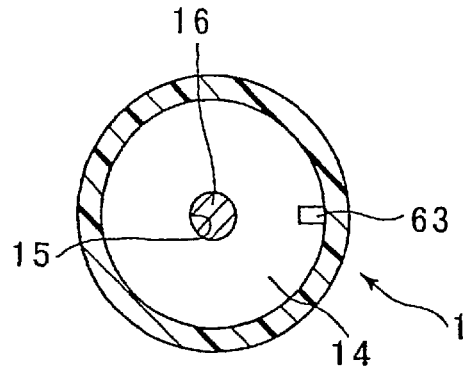
FIG. 20 is a cross-sectional view of a third modification of the wall corresponding to FIG. 17.

In a structure illustrated in FIG. 20, a rectangular notch 63 with a small area is formed on the periphery of the wall 14 and thus forms a communication hole. The notch 63 is usually sealed with the ink membrane by capillary force of the ink. Also in this structure, a gap is not formed between the inner periphery of the through hole 15 and the outer periphery of ink supply member 16.

Figure 21:
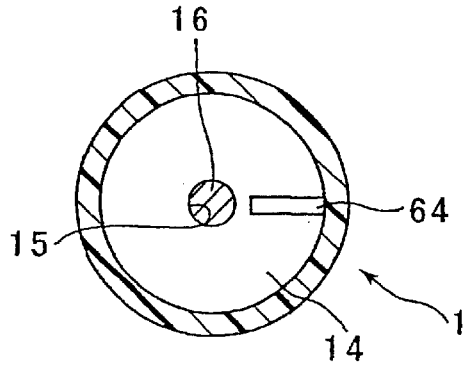
FIG. 21 is a cross-sectional view of a fourth modification of the wall corresponding to FIG. 17.

In a structure illustrated in FIG. 21, a rectangular notch 64 with sides towards the center longer than the other sides is formed on the periphery of the wall 14 and thus forms a communication hole. The notch 64 is usually sealed with the ink membrane by capillary force of the ink. An end portion of the notch 64 reaches in the vicinity of the through hole 15, and the ink supply member 16 and notch 64 are present to be able to communicate with each other by capillary force. Therefore, the membrane formed in the notch 64 is stably held. Also in this structure, a gap is not formed between the inner periphery of the through hole 15 and the outer periphery of ink supply member 16.

Figure 22:
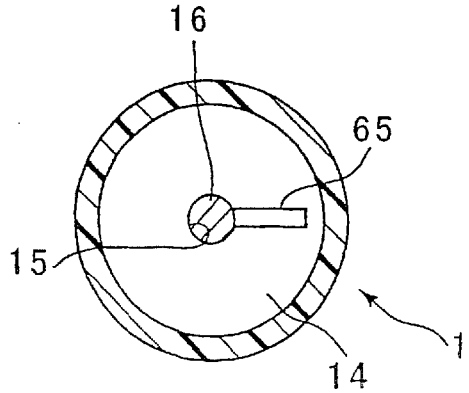
FIG. 22 is a cross-sectional view of a fifth modification of the wall corresponding to FIG. 17.

In a structure illustrated in FIG. 22, a rectangular notch 65 with sides towards the center longer than the other sides is formed around the center while directing outside. The notch 65 is usually sealed with the ink membrane by capillary force of the ink. An end portion of the notch 65 connects to the through hole 15, and the ink is communicated between the ink supply member 16 and notch 65 freely. Therefore, the membrane formed in the notch 65 is stably held. Also in this structure, a gap is not formed between the inner periphery of the through hole 15 and the outer periphery of ink supply member 16.

In the above-mentioned embodiments, in the reservoir chamber 10 is provided porous member, or cup-shaped ink holding member 13, 13*a*, 13*b* or 13*c*. However, the structure of the reservoir chamber in the present invention is capable of being modified in various ways.

Figure 23:
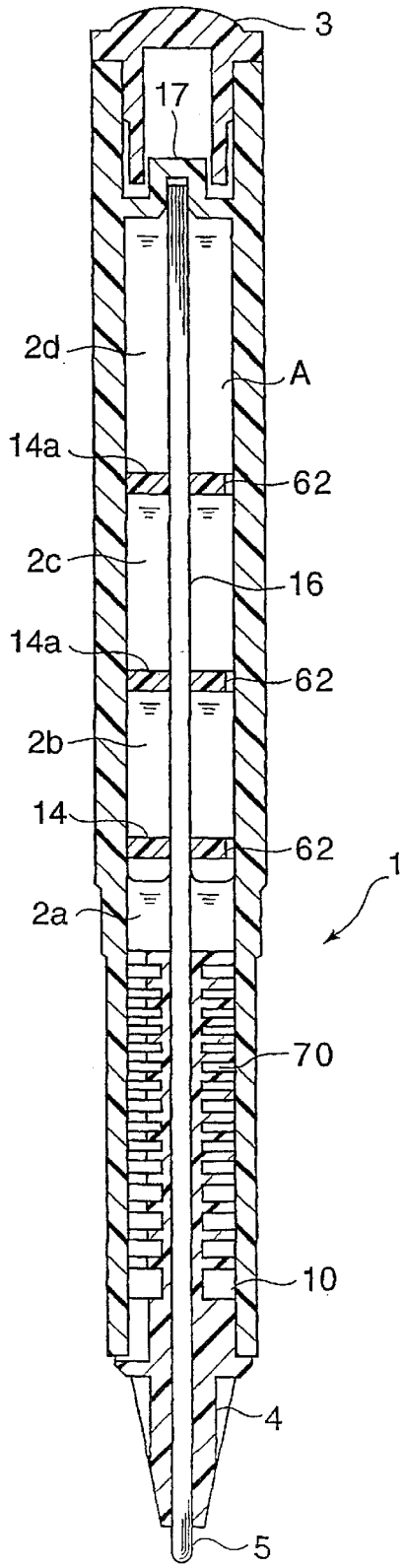
FIG. 23 is a longitudinal cross-sectional view of a writing instrument according to a twelfth embodiment of the present invention.

FIG. 23 is a view illustrating the twelfth embodiment of the present invention. In this embodiment, the reservoir chamber 10 accommodates a bellows-shaped feeder mechanism 70. The feeder mechanism 70 has the same structure as that is used conventionally, where a plurality of disk-shaped members projects in the form of bellows from the center axis portion, and circular gaps between the members holds the ink due to capillary force. In this embodiment, since the reservoirs chamber is provided with the bellows-shaped feeder mechanism 70, the pushed-out ink is held and returned reliably. Further, since the ink having flowed in the reservoir chamber 10 is held in the feeder mechanism, the ink is assuredly prevented from leaking outside from a passage causing the reservoir chamber to communicate with the atmosphere.

The present invention is not limited to the embodiments as described above, and is capable of being carried out in various modifications in type of ink, type of writing element and other parts corresponding to use and specification of writing instrument.

INDUSTRIAL APPLICABILITY

According to constitutions of the present invention, the present invention is applicable to small-sized writing instruments such as a refill-type of writing instrument and writing instrument accompanying a pocketbook, and further is applicable to disposable writing instruments and other general writing instruments.

What is claimed is:

1. A writing instrument comprising:

an ink chamber formed inside a main body of the writing instrument;

a writing element provided on a front end portion of the main body of the writing instrument;

a reservoir chamber which is formed between the ink chamber and the writing element and communicates with the atmosphere and with the writing element;

a plurality of walls which partitions the reservoir chamber and the ink chamber and further partitions the ink chamber into a plurality of small chambers in the axis direction; and an ink supply member which penetrates the plurality of walls and supplies ink from the ink chamber to the writing element, wherein a through hole through which the ink supply member passes is formed at a center portion of each of the walls, and a circular gap capable of holding the ink by capillary force is formed between an inner periphery of the through hole formed in each of the walls and an outer periphery of the ink supply member, the ink supply member is a rod-shaped member composed of a porous material, and has an ink-permeable surface on its periphery, and gas-liquid exchange between the reservoir chamber and the ink chamber and between adjacent ink chambers is performed only through the circular gap formed in each of the walls.

2. The writing instrument according to claim 1, wherein the ink supply member passes through the reservoir chamber to communicate with the writing element.

3. The writing instrument according to claim 1, wherein the writing element is formed integrally with the ink supply member.

4. The writing instrument according to claim 1, wherein a clearance between the walls in the axis direction is the smallest at a side of the writing instrument, and is increased as being spaced apart from the side of the writing instrument.

5. The writing instrument according to claim 1, wherein at least a face opposite to a side of the writing element of the walls are tapered towards the wiring element and tilted towards the through hole.

6. The writing instrument according to claim 1, wherein the reservoir chamber is provided with a porous ink holding member that holds ink having flowed out of the ink chamber.

7. The writing instrument according to claim 1, wherein the reservoir chamber is provided with a cup-shaped ink holding member that holds ink having flowed out of the ink chamber.

8. The writing instrument according to claim 1, wherein the reservoir chamber is provided with a bellows-shaped feeder mechanism.

* * * * *